US009869517B2

(12) United States Patent
Tench

(10) Patent No.: US 9,869,517 B2
(45) **Date of Patent: *Jan. 16, 2018**

(54) MISTING AND ATOMIZATION SYSTEMS AND METHOD

(71) Applicant: Theodore Tench, Jerusalem (IL)

(72) Inventor: Theodore Tench, Jerusalem (IL)

(73) Assignee: SNAPP IP LTD, Jerusalem (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/134,406

(22) Filed: Apr. 21, 2016

(65) Prior Publication Data

US 2016/0231060 A1 Aug. 11, 2016

Related U.S. Application Data

(63) Continuation-in-part of application No. PCT/US2015/034809, filed on Jun. 9, 2015, and a continuation-in-part of application No. 14/301,466, filed on Jun. 11, 2014, now Pat. No. 9,339,837.

(60) Provisional application No. 61/835,529, filed on Jun. 14, 2013.

(51) Int. Cl.

| | |
|---|---|
| ***B05B 1/34*** | (2006.01) |
| ***F28C 3/08*** | (2006.01) |
| ***B05B 9/03*** | (2006.01) |
| ***F28F 5/00*** | (2006.01) |
| ***B05B 3/08*** | (2006.01) |
| *B05B 3/10* | (2006.01) |
| *B05B 17/04* | (2006.01) |

(52) U.S. Cl.

CPC ..... *F28C 3/08* (2013.01); *B05B 3/082* (2013.01); *B05B 9/03* (2013.01); *F28F 5/00* (2013.01); *B05B 3/10* (2013.01); *B05B 17/04* (2013.01)

(58) Field of Classification Search

CPC ... F28C 3/08; F28C 5/00; B05B 3/082; B05B 9/03; B05B 3/10; B05B 17/04; B05B 17/0638; B05B 17/0653; B05B 17/068; B05B 3/1035; B05B 3/1042

USPC ..... 239/380

See application file for complete search history.

(56) References Cited

U.S. PATENT DOCUMENTS

| | | | | |
|---|---|---|---|---|
| 5,314,119 A * | 5/1994 | Watt | B05B 3/08 | 101/363 |
| 6,230,984 B1 * | 5/2001 | Jager | B05B 1/14 | 239/225.1 |
| 7,721,976 B2 * | 5/2010 | Nolte | B05B 3/1014 | 239/222.11 |

(Continued)

*Primary Examiner* — Davis Hwu

(74) *Attorney, Agent, or Firm* — Mark M. Friedman

(57) ABSTRACT

An atomization device for forming liquid particles is provided. The device includes a brush having a plurality of filaments coupled on one end thereof to the brush such that an opposing end of the filaments is free to oscillate; a plate having at least one liquid path configured for capillary action of liquid therein; wherein the brush is configured to be displaced with respect to the plate in a first direction during a cyclic displacement; and wherein disposition of the plate with respect to the brush is such that during the displacement in the first direction the filaments are displaced between a first position in which the opposing end is engaged with an edge of the liquid path collecting thereby film of liquid therefrom, and a second position in which the opposing end is free to oscillate in an alternating motion between the first direction and a second opposing direction.

18 Claims, 10 Drawing Sheets

(56) References Cited

U.S. PATENT DOCUMENTS

| | | | | |
|---|---|---|---|---|
| 8,960,568 | B2 * | 2/2015 | Chen | B05B 3/08 239/214.21 |
| 9,339,837 | B2 * | 5/2016 | Tench | B05B 17/0638 |
| 2003/0178505 | A1 * | 9/2003 | Binder | B05B 3/0463 239/225.1 |
| 2010/0301139 | A1 * | 12/2010 | Achord | B63B 59/10 239/380 |

* cited by examiner

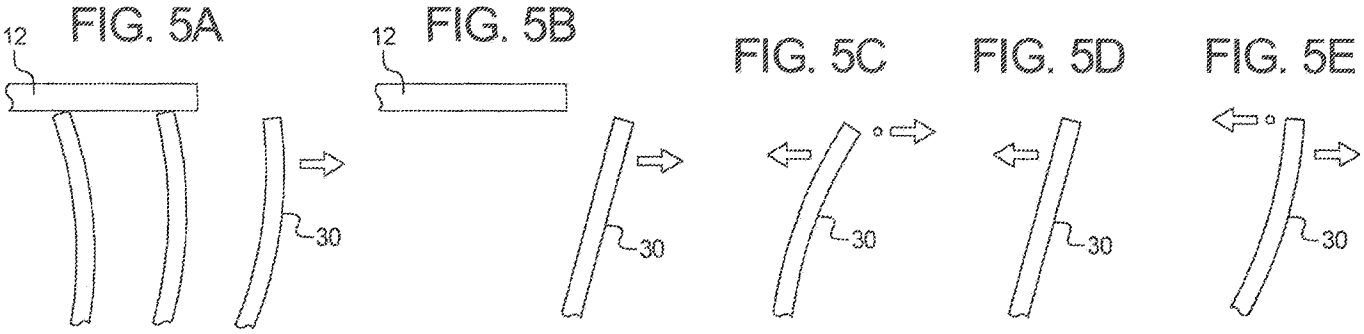
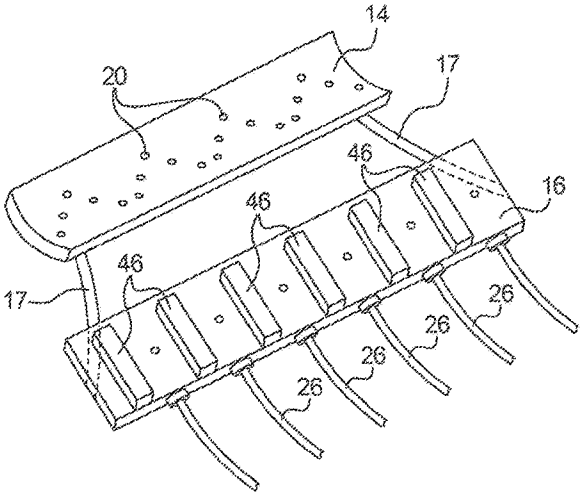
FIG. 6

MISTING AND ATOMIZATION SYSTEMS AND METHOD

FIELD OF INVENTION

The presently disclosed subject matter relates to an improved misting and atomization system in general, and in particular to a cooling apparatus having an atomization system.

BACKGROUND

The present subject matter relates generally to misting and atomization systems and methods that may be used to spray liquids, such as water, paint, and others.

There are various misting or spraying methods for various liquids. Each has its own drawbacks and challenges. Many of the problems with currently available systems and methods are well illustrated with reference to conventional paint sprayers or mist cooling atomizers. Accordingly, much of the present disclosure references these applications. However, it is understood that the teachings provided herein with respect to paint and mist cooling are applicable across a great range of fluids.

A common method for applying paint to a surface involves the use of a cylindrically shaped paint roller or brush dipped into a supply of paint. Whereas these methods provide adequate penetration of the paint to a surface, these methods are both time consuming and messy.

In contrast, spray methods have been developed that allow for a faster painting process, but these methods have their own disadvantages. Various spray painting systems have been proposed where the paint is delivered under power to a paint applicator. Unfortunately, in these systems the paint applicator has a tendency to become clogged, thereby rendering the system useless and requiring the user to buy a replacement device.

In addition, the current spray paint devices do not provide paint to a substrate in a controlled manner such that the paint is delivered at the proper rate. In order to achieve optimal atomization extremely high pressures must be used, forcing the equipment to spray over five gallons an hour in common working conditions. Only a very small percentage of highly trained technicians are capable of applying so great a torrent of paint accurately. Further, paint is often distributed with an improper uniformity or irregularity to a paint surface. Moreover, minor variations in paint viscosity by dilution produces unpredictable spray quality with the present devices. As a result, fine-tuning the spray by measuring viscosity is difficult with the present devices.

Further, instead of providing an even distribution of spray over a wide spray pattern, current spray devices may force spray through a tiny hole to provide a spray pattern that is uneven. More paint is delivered in the center of the spray than at the edges. In factory settings where a wide swath of paint is desired, complex set-ups of numerous nozzles must be designed and fine-tuned in their proximity one to another in order to approximate even distribution. And of course, if one of the nozzles clogs, the entire paint session is compromised. Additionally, the high pressures used in such systems rapidly wear out the nozzle, ruining the spray quality, and requiring frequent monitoring and replacement.

Another serious drawback to almost all conventional paint sprayers is overspray. For example, a fog of paint particles is produced by the atomization process that fills up whole rooms with tiny droplets that stick on any surface. Overspray is also dangerous: most spray paint must be applied while wearing a mask to prevent inhalation of the paint droplets, which can be life-threatening. In a factory setting, spray paint is usually applied in sealed boxes or small rooms with special blowers for ventilation. Spray paint applied in private homes demands protecting every surface where paint is not wanted by covering it with airtight layers of plastic sheeting. Even adjoining rooms must be protected this way. Overspray constitutes wasted paint that can often reach over 30% of all paint sprayed, a considerable loss, especially considering the considerable cost of the paint and cleaning up.

A further drawback of conventional spray paint methods is bounceback. Specifically, the atomization process frequently creates a high-speed blast of air moving around the paint droplets. The air blast air flow reflects off the application target and pushes other droplets on their way to the target away from the target completely. As a side effect of bounceback, many current paint sprayers are incapable of filling small cracks under 2 mm or so width with any paint to any depth. A further drawback to the high air flow causing the bounceback is that it blows on the droplets at great speed and can dry them out before they hit the target.

Moreover, many of the powered painting systems are complicated with numerous parts and, therefore, difficult to clean and repair. Cleanup of a sprayer, even the most expensive ones, can take hours and even require soaking overnight.

Changing paint colors in the middle of an application project is not an option for conventional equipment. Moreover, typical conventional systems are only suited for one type of liquid, namely, paint. Therefore, a user would need to purchase an entirely different device to supply other liquids, such as insecticides or air fresheners.

Further, the current powered painting systems require a substantial amount of energy, high pressure, electrical cords, battery packs, or pumps in order to supply the paint to a surface.

Cooling by water evaporation is another common application of atomization devices that presents its own range of challenges. Inexpensive cooling mists fail to atomize well, and produce sprays that are both uncomfortable and inefficient. For example, the large droplets produced by these low-cost atomization devices are so uncomfortable that it is virtually impossible to sit directly in the atomization path and air flow path. Second, the conventional atomization devices produce particles of a size so large that many of them never evaporate at all, thus failing to produce a cooling effect.

More expensive mist cooling systems do produce quality atomization. However, the high pressures required to produce the atomization have an undesired effect of raising the humidity in the environment of the device. For example, the water flow from a minimum four nozzle installation is rarely less than 0.116 gallons per minute and usually more than that—an amount of water so great that in one minute the device will increase the humidity of almost 2,000 cubic feet of air from 50% to 70% or more humidity. At such levels the evaporative cooling system becomes remarkably less efficient. In addition, this added humidity is uncomfortable to the users of the system, which typically use the system in order to cool themselves. In other words, the conventional systems deny the users the direct benefit of the cooling and greatly increase the overall humidity.

Further disadvantages of typical cooling systems include the high cost of the device relative to the minimal cooling they produce. In addition, the cooling devices typically produce uncomfortably large amounts of noise up to more than 60 decibels from the operation of the compressor, from the operation of fans large enough to handle the high levels of mist, and from the quite loud hissing of the nozzles. Further, the current cooling devices typically only produce mist from one spray nozzle at a time, necessitating multiple nozzles for increased cooling. Finally, because the atomization concentrates all the droplets into a very small area around the one tiny point from which they are all sprayed, the best atomizers have an additional drawback of creating a heavy fog which is distracting, uncomfortable, and easily re-condenses on smooth surfaces.

Accordingly, there is a need for a device to supply atomization in a consistent manner, quietly, with a relatively simple structure and assembly, such that the system leads to easy maintenance and cleaning, as well as adaptability during use.

SUMMARY OF INVENTION

The present disclosure provides devices and methods for implementing an atomization device. Various examples of the device and method are provided herein.

The disclosed device provides a fine mist with critically smaller particles than those devices within the prior art. The fine mist is at least in part a result of the design of the device, which relies on the combination of two processes: first, a limited adhesion of liquid onto filaments, and second, a controlled oscillation of the filaments as they release one droplet at each oscillation. The liquid is released from the filaments in a stream after the filament is snapped and subsequently undergoes an oscillation process, wherein the filament bends forward and back through a neutral position of the filament.

Specifically, the disclosed device includes a brush and a contact plate, wherein the contact plate includes a plurality of capillary openings. Liquid is supplied to a cavity or space beneath the capillary openings for the capillaries to absorb into the capillary openings without additional force. In the operation of the device the capillary tubes can be 'starved' of liquid—never provided with enough liquid to fill them to the limit that capillary action would allow. Instead, the meniscus at the top of the tubes can become bent in an exaggerated hyperbola to present only a small edge of liquid to contact from above. As the brush contacts the contact plate, its filaments are dragged one by one over the capillary openings, where small amounts of liquid (between 0.0000001 and 0.000000001 cubic centimeters) inside the capillary openings adhere to the individual filaments of the brush. As the brush rotation continues, the filaments maintain contact with the plate, carrying with them this liquid. The liquid is then broken up into even smaller parts and released from the filaments when the filaments break contact with the contact plate and oscillate, releasing one drop at a time with each direction change. In the case of a brush spinning axially, the liquid is released approximately 180 degrees from the contact plate. The contact plate may include a compressed radius, wherein the filaments undergo a continuous bending and release operation deforming the filaments from their rest state, building up and releasing their elastic potential energy without creating any impact that would cause the filaments to shed any liquid before the point of release. The compressed radius prevents an excess of liquid buildup from collecting at the release point.

When used with liquids of the viscosity of water, the depth of the enclosed cavity beneath the contact plate is fixed at approximately 1 to 2 millimeters, providing a vital, very simple and low-cost method of continually supplying liquid to the capillary openings without flooding them. By means of capillary and other forces acting on the liquid in the narrow space it defines, the space forces the liquid to disperse itself evenly throughout the area beneath the capillary tubes, without allowing the formation of full-sized droplets which, if adhered to the filaments, would destroy quality atomization. This is accomplished with a simple mechanical structure without moving parts. Furthermore, relying on the various properties of water-like liquids that function in this small a space, the cavity now allows the device to be used in any orientation, preventing gravity from collecting the liquid too much in any one place and flooding the filaments. If the device is used to atomize a liquid of the viscosity of water, the space may be 1 to 2 mm in depth, at which distance the water will be dispersed and fill up the space according the natural viscosity, capillary action and adhesive powers of the liquid. If a surfeit of liquid is prevented from entering the space, these natural forces will keep the liquid firmly inside the space, preventing it from leaving the top of the capillary tubes unless the filaments drag small amounts out by adhesion, and allowing the device to be utilized in any orientation, even upside down, without any liquid leaving the space by forces other than the adhesion of the filaments.

The specific design of the present device releases liquid absorbed onto filaments or bristles approximately 180 degrees from a contact plate, wherein the contact plate provides the liquid to the filaments. In contrast, most conventional misting devices that rely on flicking to produce atomization spray approximately 90 degrees from a snap bar.

The liquid released in the stream begins approximately three hundredths of a second after the filament is snapped from a contact plate, which is also the time it takes for the first oscillation. The stream continues for up to two tenths of a second afterwards. In contrast, conventional misting devices flick larger sized droplets of liquid directly off a bar at the moment the filament is released. In other words, the present system includes an oscillation function that produces much smaller droplets than conventional low rpm devices that do not include an oscillation function.

As the brush contacts the contact plate, a very small amount of liquid inside the capillary openings adheres to the tips of the filaments of the brush. The limited adhesion property of the device is such that the amount of liquid available to each filament as it is dragged over the capillary openings is between 0.0000001 and 0.000000001 cubic centimeter. In contrast, conventional devices grant filaments access to much larger amounts of liquid at this stage, where natural forces make them absorb many times more liquid than the present device, drastically increasing the size of the particles that are subsequently released and lowering the quality of atomization. Only very high rpm's can atomize these amounts of liquid effectively, and then only at a high cost in energy and noise. As a result of the limited adhesion process, the present devices produces a fine mist at rpm's of 800 or even 400, a fraction of the thousands of rpm's required by other devices to achieve good atomization.

The atomization of the liquid from the device is a result of releasing the flexed filaments from contact plate, wherein the filament returns to its resting or normal linear position. Specifically, after release, the filament moves through its normal linear position into a forward flexed position before returning back to its normal linear position. The oscillation produces atomization because the acceleration produced from the oscillation is comparable to that of a spinning disc atomization system rotating at 3,500 rpm. Because the oscillations continue after the filament is released, and because the filament is in an axial spin conformation, the liquid is released 180 degrees from the contact plate. Further, this oscillation process greatly enhances the atomization by breaking up the tiny amount of liquid on the filament head into even smaller amounts: only one droplet is released with each oscillation of a filament. Determination of the number of oscillations and the strength providing the oscillation is enough force to atomize the liquid is dependent on understanding numerous properties of the filament material, thickness, length, and the amount by which the filament is bent before release. Atomization by oscillation prevents overspray: the particles are all ejected with parallel forward momentum and identical forward speed at the extreme end of the oscillation cycle. So they never hover and wander away from the stream like the product of traditional pressure sprayers. Further, the oscillation provides the benefit of a highly diffused swath of atomized particles, separated from each other automatically by the one-at-a-time release of particles.

The length of the filaments may be any suitable length. For example, shorter filament lengths produce a faster snap to release the liquid from the filament. Shorter filaments are particularly suitable for releasing higher viscosity liquids, such as paint. A greater rotation speed also increases the snap force. The filaments may be made of any material that has elastic potential energy on deformation, including stainless steel, spring steel, and other materials.

No bounce-back: the device produces next to no air flow accompanying the droplets, since the air flow produced by spinning the filaments is nearly negligible. At the same time, the device may produce liquid particles or droplets that are projected at a rate that is faster than the forward momentum created by the rotation of the filaments, because the speed of the snap is additional to the speed of the rotation of the brush. For example, when the brush is rotated at approximately 900 rpm, a forward speed of 2 m/s is produced, and the snap of the filaments off the contact plate adds an additional 2 m/s to the speed of the projected droplets. This combination of the droplets having high air speed, and the air surrounding them having very low speed, means that instead of 'bounce back', the droplets actually race ahead of the air flow unencumbered. As a result, the device is suitable for dispensing a mist of paint to cover inside cracks on a substrate as thin as 1 mm wide and over 10 mm deep.

The present disclosure provides an atomization device including a contact plate including a top plate and a bottom plate, wherein the top plate and bottom plate are separated a distance to define a space between them. The top plate includes a plurality of capillary openings that extend through the top plate from a top surface to a bottom surface. The device further includes a liquid source in fluid communication with the space, wherein the liquid source supplies a limited amount of liquid to the space and the plurality of capillary openings, and a brush including a plurality of a filaments radiating from a central axis of the rotating brush.

As the brush rotates a first radial direction, the filaments flex when in contact with the contact plate and release when contact is broken with the contact plate to project liquid from the filaments, wherein the portion of the contact plate with which the filaments contact includes a spirally curved surface, wherein the radius decreases along a path following the first radial direction.

In an example, the device includes a cylindrical housing, wherein the housing includes the contact plate and the rotating brush, wherein the housing includes an opening, wherein, as the brush rotates, liquid from the filaments projects through the opening. The housing may include a top portion and a bottom portion, wherein the contact plate is positioned within the bottom portion, wherein the opening is positioned within the top portion.

In another example, the device includes an arcuate bather extending from below the contact plate around a portion of the brush, wherein the arcuate barrier collects a portion of a liquid released from the filaments, wherein the barrier is in fluid communication with the liquid source. The barrier may collect non-atomized, larger droplets that are immediately released from the contact plate by the filaments. The large droplets are the sole product of many conventional atomization devices. In contrast, the present device removes the large droplets from the stream to maintain a desired smaller droplet size in the form of mist. In addition, the barrier may catch droplets that have been hurled backwards by the oscillation of the filaments. In other words, only liquid projecting from filaments in a forward direction from the oscillation produce the resulting mist. The liquid projected from backward oscillation movement may be collected by the barrier.

The rotation of the brush may be driven by a motor or manually. In an example, the device is configured to convert 600 mL of liquid into a mist per hour.

In an example, the device is enabled to dispense liquid from the filaments, wherein the liquid may be projected in the form of liquid particles, wherein all the droplets have a diameter size of 70 microns or less, with the average size under 35 microns. The device may be adapted to produce liquid particles having a size between, and including, 20 μm to 350 μm. The device may be adapted to produce liquid particles having a size between, and including, 20 μm to 100 μm.

The diameter of the capillary openings may be between, and including, 0.5 mm to 2.0 mm. In an example, the diameter of the capillary openings is 1 mm, 1.5 mm, 2 mm, or 2.5 mm.

The capillary openings may include liquid, wherein a portion of the liquid carried by the filaments is released from the filaments approximately 180 degrees from the contact plate, wherein the approximately 180 degrees is measured along the radial path of the rotating brush.

The liquid source may control the release of liquid to maintain an amount of liquid in the capillary openings such that the liquid does not overflow onto the top surface of the top plate. In an example, the liquid source includes a positive pressure source, wherein the positive pressure maintains an amount of liquid between the top plate and bottom plate.

The present disclosure also provides an atomization method including providing an atomization device, as disclosed above. The method further includes rotating the brush such that the filaments contact the contact plate, wherein the filaments absorb a portion of the liquid feeding to the filaments from within the capillary openings. As the brush rotates a first radial direction, the filaments flex when in contact with the contact plate and release when contact is broken with the contact plate to project liquid from the filaments, wherein the portion of the contact plate with which the filaments contact includes a spirally curved surface, wherein the radius decreases along a path following the first radial direction.

The method may include, when contact is broken with the contact plate, the filament oscillates between a forward bend position and a backwards bend position through a linear position, wherein the filament projects liquid each time the filament changes direction, at the forward bend position and at the backward bend position.

An advantage of the device provided herein includes providing a more cost effective, energy efficient misting device than those devices that use high rpm's of discs or brushes, or high pressure to dispense the liquid. In the present device, energy is only expended when atomization takes place. In contrast, in conventional devices, a majority of the energy required by the device is wasted maintaining a constant supply of power for the device, even through a great majority of the power is not used for the actual atomization.

Another advantage of the device is that it is quiet: atomization by oscillating filaments produces so very little noise that it can comfortably be utilized in residential surroundings. The device can operate within the recommended sound pressure for interior living areas, under 50 decibels at a distance of 6 feet from the unit. For example, many current mist cooling systems are over ten times louder than this, 60 decibels and more.

Another advantage of the device provided herein is that the device may be used to dispense paint, insecticide, air freshener, among other things, in contrast to current misting or spraying devices which are only designed to spray one type of material. The present device may include interchangeable rotating brushes and barriers which may be selected depending on the type of material or liquid used. For example, a user may find it advantageous to use a different rotating brush for use with a latex based paint than when used with water. For example, stiffer bristles may be helpful when the device is used with paint.

Yet another advantage of the device is that it produces a more moderate rate of spray than other conventional devices. As a result, users of the device may apply a spray at a more manageable rate of one inch per second for painting a trim line accurate to 1/16th of an inch. Therefore, the present device may be easily operated by any person, not just professionals.

Another advantage of the device when used for mist cooling is that the device produces a comfortably fine and highly diffused cooling mist for users, wherein the stream may be pointed directly on the user. Further, such a direct stream can provide ample cooling with much more efficient water use than other systems that because of the discomfort of their direct stream must rely on cooling the entire atmosphere around the subject. Using much less water for evaporation, the present device does not increase the humidity of the environment as much as those systems.

Yet another advantage of the device is that the spray originates over the entire length of the brush, not just in one point. The spread of liquid produces a more even coverage of paint.

Another advantage of the device provided herein is that the device does not clog, in contrast to most commercial misting devices. With no passage smaller than about 1 millimeter in the case of water misting, and about 2 millimeter in the case of paint spraying, ample room is provided for all common foreign matter in an ordinary liquid to pass without clogging. Further, in the example of dispensing latex paint, the device does not require dilution of the paint before dispensing.

A further advantage of the device provided herein is that the device is convenient and easy to take apart and clean.

Yet another advantage of the device disclosed herein is that the device is designed to easily modify the size of the swath of mist extruded from the device, even during use. For example, swaths of spray greater than 20 feet long may be produced, which is typically not achievable by other conventional systems without using multiple nozzles. Further, the swath size produced by the present device may be modified during use of the device.

Another advantage of the present invention is a substantial reduction in overspray. In other words, the present device prevents the loss of excess spray that is sacrificed as waste. Due to the lack of overspray, the present device is safer for users to use. The device does not produce overspray because the device does not project the droplets in all directions like conventional spraying devices, which produce a cloud of mist that the user has to avoid inhaling. Instead, the present device produces a spray in a direct line of paint droplets.

A further advantage of the present device is that it in some conformations it may be used in any orientation. In contrast, conventional sprayers may only be used in one orientation. The present device may be tilted and even turned upside down during use.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

There is disclosed in accordance with an aspect of the presently disclosed subject matter an atomization device for forming liquid particles. The device includes a brush having a plurality of filaments, each of the filaments is coupled on one end thereof to the brush such that an opposing end of the filaments is free to oscillate; a plate having at least one liquid path configured for capillary action of liquid therein; wherein one of the brush and the plate is configured to be displaced with respect to the other one of the brush and the plate in a first direction during a cyclic displacement; and wherein disposition of the plate with respect to the brush is such that during the displacement in the first direction at least one of the filaments is displaced between a first position in which the opposing end is engaged with an edge of the liquid path collecting thereby a film of liquid therefrom, and a second position in which the opposing end is free to oscillate in an alternating motion between the first direction and a second opposing direction, and wherein the alternating motion is triggered by forces exerted on the opposing end during disengagement thereof from the edge of the liquid path.

The cyclic displacement can be a rotation displacement and the brush can be a rotating brush configured to rotate in the first direction with respect to the plate.

During the alternating motion of the filament the opposing end changes direction from the first direction to the second direction a particle of liquid can be dislodged from the opposing end.

The brush can include a plurality of filaments coupled along a width thereof and the plate includes a plurality of liquid paths, the plate extends along the width such that in the first position each of the filaments can be engaged with the edge of at least one of the liquid paths allowing thereby the plurality of filaments to simultaneously collect liquid from the liquid paths.

Dimensions of the liquid path can be configured such that surface tension and adhesive forces between liquid and walls of the liquid path causes the capillary action and in wherein the dimension are configured in accordance with a cohesion property of the liquid.

The at least one liquid path can be a channel having an opening along a portion thereof reducing thereby the capillary rise rate. The channel includes a bottom wall and two side walls wherein the opening can be defined along a top portion thereof such that liquid therein interacts only with the bottom wall and the two side walls.

The plate can be disposed inside a liquid trough, and can be configured such that a liquid level therein allows the capillary action. The plate can be diagonally disposed with respect to the trough wherein angle of the plate with respect to the trough can be determined in accordance with the desired rate of the capillary action. The trough can include a plurality of partitions successively defined along the length of the plate and configured such that the liquid level can be maintained in each of the partitions.

The atomization device can further include a liquid passage defined along the partitions and having openings configured for providing liquid into each of the partitions at a desired flow rate. Each of the partitions includes a draining aperture configured such that gravitational forces exerted by the liquid pressure in the partition force liquid out the partition through the draining aperture maintaining thereby the liquid level in the partitions.

The brush includes a plurality of filaments configured to successively engage the edge and wherein engagement of each filament with the edge causes deformation of the meniscus in a top surface of the liquid in the liquid path decreasing the height of the meniscus as measured in the middle of the liquid path, and wherein rate of the capillary action can be configured such that the time interval between engagement of a filament and engagement of a successive filament, can be controlled to be shorter than time required for the capillary action to return the meniscus to its full height.

Each of the filaments can be configured to bend back to the second opposite direction only after the rotating brush can be rotated approximately 90 degrees with respect to the plate.

The atomization device can further include a collecting member extending along a portion of a path defined by the first direction and configured to collect excess liquid absorbed by the filaments.

There is provided in accordance with another aspect of the presently disclosed subject matter a cooling apparatus for producing air stream. The apparatus includes an air blowing device configured to blow an airstream in a first direction; an atomization device configured to receive liquid from a liquid source and to spray particles of the liquid towards the airstream lowering thereby the temperature of the airstream; wherein the particles are sprayed in a second direction transversely of the first direction.

The air blowing device can be a fan rotating about an axis and wherein the apparatus includes a housing having an inlet opening and an outlet opening and wherein the airstream can be directed from the inlet opening towards the outlet opening, and wherein the rotating brush can be configured to rotate.

The atomization device can include a brush having a filament and further includes a plate having at least one liquid path configured for capillary action of liquid therein; wherein the filament can be configured to collect the liquid from the plate.

Rate of the capillary action can be configured in accordance with the desired temperature of the airstream.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIGS. 5A-5E is a side view of an embodiment of a filament before and after breaking contact with the contact plate.

FIG. 6 is an exploded view of an embodiment of a contact plate.

DETAILED DESCRIPTION OF EMBODIMENTS

Figure 1:
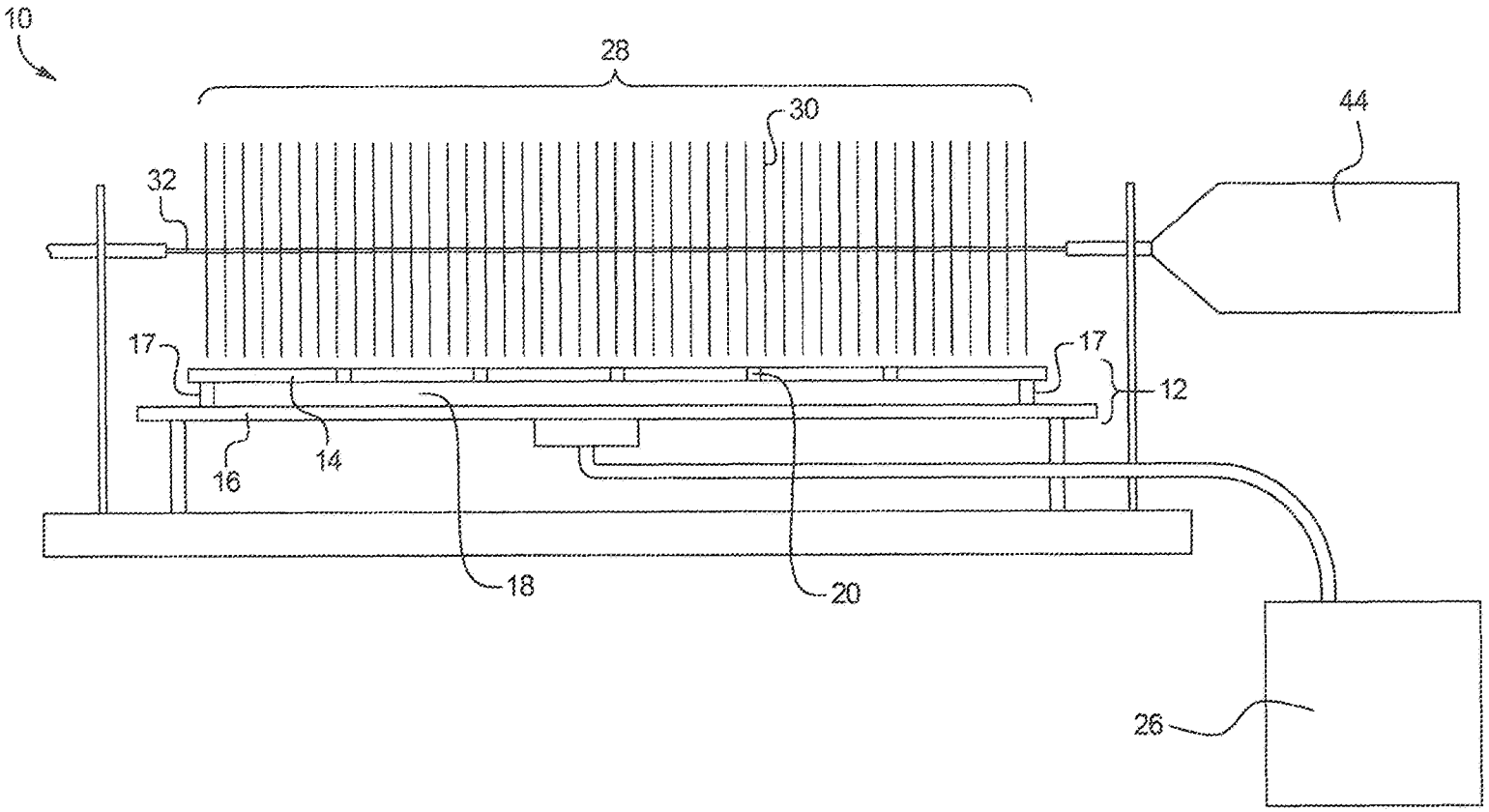
FIG. 1 is a side view of an embodiment of an atomization device.
Figure 2:
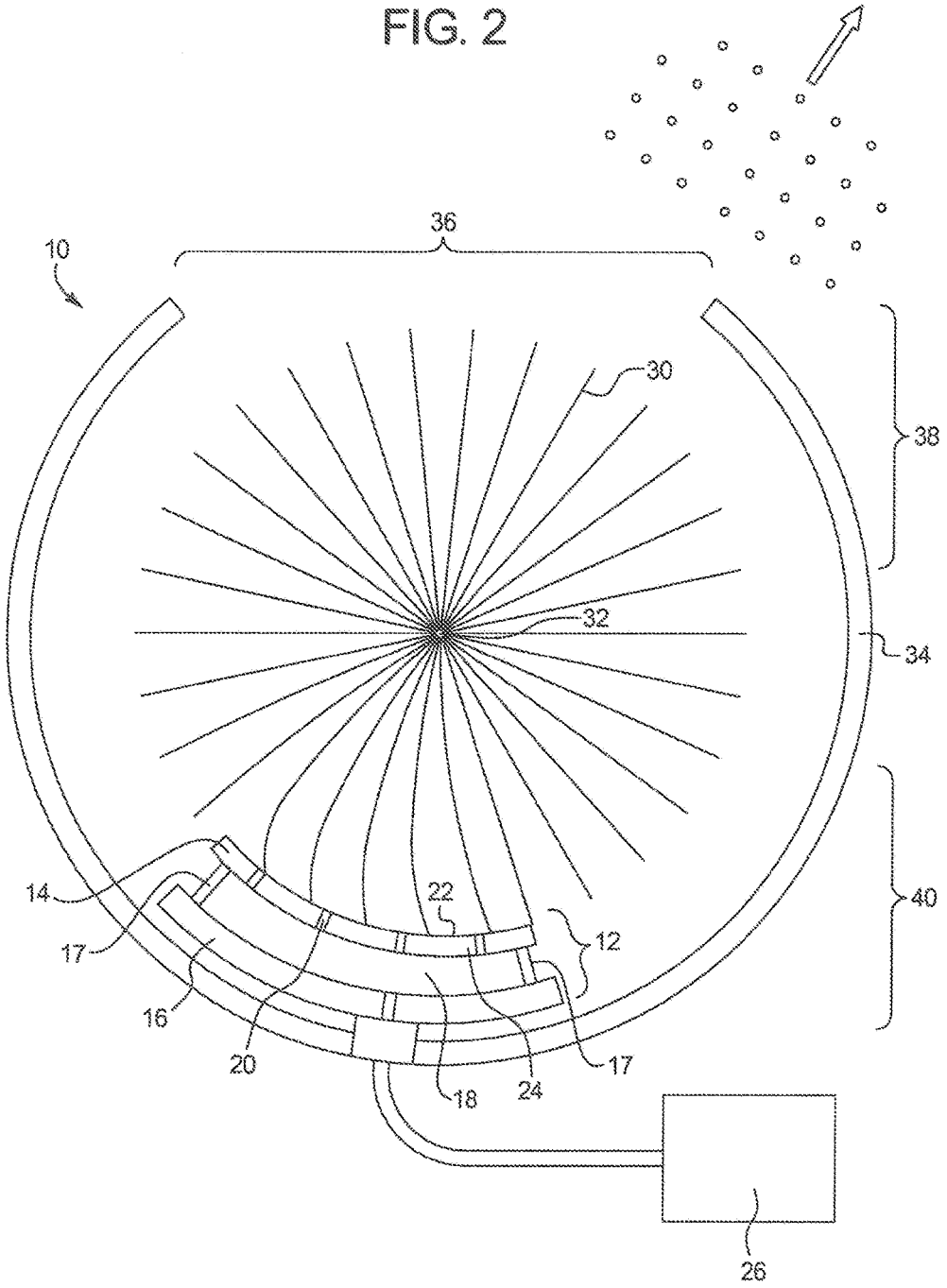
FIG. 2 is a cross-sectional view of an embodiment of an atomization device including a housing.
Figure 3:
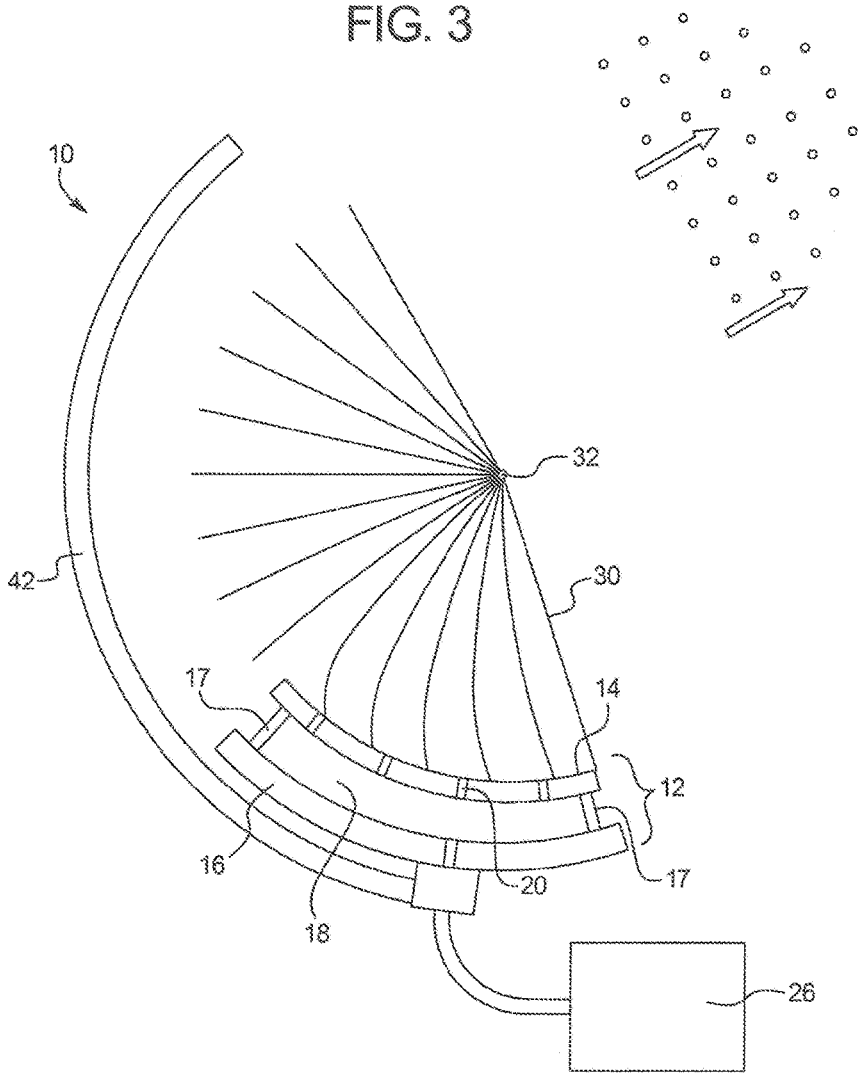
FIG. 3 is a cross-sectional view of an embodiment of an atomization device including a bather.

FIG. 1 depicts an embodiment of an atomization device 10 as provided by the present disclosure, wherein the device 10 includes a contact plate 12, a liquid source 26, and a brush 28. The contact plate 12 includes a top plate 14 and a bottom plate 16. The top plate 14 and bottom plate 16 are connected such that a connector 17 encloses a space 18 between the top plate 14 and bottom plate 16. The top plate 14 may be connected to the bottom plate 16 by any suitable connector 17, as shown in FIGS. 1-3. The connector 17 may include, but not limited to, a wall, screw, nail, bolt, latch, among others. Further, the connector 17 may be any suitable material, such as plastic. Alternatively, the top plate 14 and bottom plate 14 may be directly connected to each other, for example, by welding, glue, or any suitable adhesive.

The top plate 14 includes a plurality of capillary openings 20 that extend through the top plate 14 from a top surface 22 to a bottom surface 24. The capillary openings 20 are adapted to absorb liquid from the space 18 below the top plate 14 based on capillary action, and to present extremely small amounts of the liquid to adhere to the heads of the filaments 30 when they contact the tops of the openings. The diameter of the capillary openings 20 may be increased or decreased to suit liquids of different viscosity, or to modify a projected droplet size. The capillary openings 20 may be arranged in any suitable manner that ensures the filaments 30 which are to atomize in the desired process have access to the liquid within the capillary openings 20. For example, the capillary openings 20 may be arranged in a staggered grid pattern.

The diameter of the capillary openings 20 may be any suitable diameter to produce atomization of the liquid. The diameter of the capillary openings 20 may be at least 0.1 mm, at least 0.3 mm, at least 0.5 mm, at least 0.7 mm, at least 0.9 mm, or at least 1.1 min. Alternatively, or in addition to, the diameter of the capillary openings 20 may be less than 3 mm, less than 2 mm, less than 1.5 mm, less than 1.3 mm, less than 1.1 mm, less than 0.9 mm, less than 0.7 mm, or less than 0.5 mm. The diameter of the capillary openings 20 may be defined by any two of the above endpoints. For example, the diameter of the capillary openings 20 may be between, and including, 0.5 mm to 1.5 mm, 0.9 mm to 1.1 mm, 0.7 mm to 1.3 mm, or 0.9 mm to 1.3 mm. In an example, the diameter of the capillary openings 20 is 1 mm.

The space between the top plate 14 and the bottom plate 16 may be approximately from 0.5 mm to 2 mm, for example 1 mm. Due to the close proximity of the top plate 14 and bottom plate 16 in addition to the interplay of capillary action in the case of a liquid with the viscosity of water, the device 10 may be used in any orientation. In other words, the contact plate 12 adequately supplies liquid through the capillary openings 20 to the filaments 30 in any orientation of the device, including upright or upside down.

In addition, a portion of the contact plate 12 includes a spirally curved surface with which the filaments 30 contact. As the brush 28 rotates in a first radial direction, the radius of the spirally curved surface decreases along a path following the first radial direction. As a result, a filament 30 of the brush is progressively more intensely flexed as the filament 30 approaches the end of the spirally curved surface.

An advantage of the top plate 14 including a spiral curved surface includes preventing the accumulation of liquid behind a strike plate, an element common in conventional sprayers that is used to snap bristles to release their droplets. Any liquid that accumulates behind a strike plate is typically attached to subsequent approaching bristles, and will drastically increase the projected drop size and negatively impair atomization. The spiral curved surface of the top plate 14 maintains an optimal amount of liquid on the filaments 30 and prevents liquid from accumulating on the top surface 22 of the top plate 14 and subsequently absorbed by filaments 30, which negatively impairs atomization.

As mentioned above, the device 10 further includes a liquid source 26 in fluid communication with the space 18, wherein the liquid source 26 supplies a liquid to the space 18, wherein the plurality of capillary openings 20 access the liquid from the space 18. As shown in FIGS. 1-3, the liquid source may attach to the bottom plate 16, for example through an opening within the bottom plate 16, wherein the liquid may flow from the liquid source 26 into the space 18. The liquid source 26 may supply any suitable liquid to the space 18.

The liquid source 26 may control the release of liquid to maintain an amount of liquid in the space 18 such that the liquid does not overflow the capillary openings 20 and onto the top surface 22 of the top plate 14. In an example, the liquid source 26 includes a positive pressure source, wherein the positive pressure maintains an amount of liquid between the top plate 14 and bottom plate 16.

The liquid source 26 may be externally located from the contact plate 12. Alternatively, or in addition to, the liquid source 26 may be internally located within a housing 34, discussed more below. Further, the liquid source 20 may be in fluid communication with a liquid reservoir that supplies the liquid source 20 with liquid.

In one example, if the amount of liquid supplied from the liquid source 26 is too great, the device 10 will not produce a consistent mist of liquid, but rather dispense inconsistent droplets of too large a size. Alternatively, if the amount of liquid supplied from the liquid source 26 is too little, the device 10 may not produce a consistent mist of liquid, but instead have gaps in its spray. Preferably, the liquid source controls the release of liquid to maintain an amount of liquid in the capillary openings less than a full capacity of the capillary openings.

The liquid supplied by the liquid source 20 may be any suitable type of liquid including, but not limited to, water, paint, insecticide, air freshener, fuel, pharmaceutical coatings, industrial coatings, industrial oil, cooking oil, body creams, combustible liquid or petroleum derivatives, or a combination thereof. In the main embodiments described herein, the misting device 10 is generally configured to perform with paint, which is a fluid that has shear thinning properties (i.e., the fluid's resistance to flow decreases with an increasing rate of shear stress). However, one skilled in the art would understand to slightly modify the elements of the systems disclosed herein for liquids that are not shear thinning materials based on the solutions and description provided herein.

The device 10 also includes a brush 28 including a plurality of a filaments 30 radiating from a central axis 32 of the rotating brush 28. As the brush 28 rotates a first radial direction with the filament heads in contact with the plate, liquid adheres to the filament heads from within the capillary openings, the filaments 30 flex when in contact with the contact plate 12 and release when contact is broken with the contact plate 12 to project liquid from the filaments 30. Once contact is broken between the filaments 30 and the contact plate 12, the oscillation process begins, which will atomize the liquid on the filaments, one drop with each oscillation. Alternatively, the brush 28 may be linear, wherein the filaments 30 extend from one side of the brush 28. In such example, instead of rotating the brush, a horizontal brush 28 may slide or vibrate over the contact plate 12.

The filaments 30 may be comprised of various materials with a range of flexibilities. In one example, the filaments 30 may comprise flexible material. The level of flexibility of the filaments 30 must be such that, upon contact with the contact plate 12, the filaments 30 bend or flex from their original orientation. Upon release from the contact barrier 12, the filaments 30 oscillate rapidly until the filaments 30 return back to their original, linear orientation, thereby releasing liquid from the filaments 30 in each oscillation.

As explained more below, upon release, the filaments 30 typically not only spring back into their original orientation, but continue to bend past their original orientation into a forward bend position and then back to their linear position. The filaments 30 may then bend back to a backwards bend position, after which the filament 30 returns back to the linear position. This oscillation from the forward bend position to the backwards bend position creates the mist or atomization as the liquid leaves the filaments 30 each time the filament 30 oscillates away from the forward or the backward bend position. The filaments 30 are flexible enough to bend and spring back to their original orientation to allow the liquid on the filaments 30 to be projected in the form of a mist. In an example with a filament 30 having a length of one inch, the filament 30 may oscillate approximately 20 times before returning to its neutral, linear position.

The filaments 30 may be equally dispersed on the rotating brush 24. Alternatively, the filaments 30 may be arranged in any number of patterns, such as rows, along the rotating brush. The projected droplet size can also be moderated by changing the distribution of filaments 30 across the face or the surface of the central axis 32 of the brush 28. The more spread out the filaments 30 are on a surface of the central axis 32, the more discreet individual droplets are projected. Further, the filaments 30 may extend perpendicular from a surface of the brush 24. Alternatively, the filaments 30 may extend at an angle other than perpendicular, such as sloping backwards from the direction of rotation so as to project droplets in a direction closer to a line pointing outwards from the center of the brush (in contrast to a tangential line of droplets projected by filaments 30 extending perpendicular from the brush 24).

The length of the filaments 30 may be any suitable length to produce atomization of the liquid. The length of the filament 30 may be at least 10 mm, at least 15 mm, at least 20 mm, at least 25 mm, at least 30 mm, at least 35 mm, or at least 40 mm. Alternatively, or in addition to, the length of the filaments 30 may be less than 50 mm, less than 45 mm, less than 40 mm, less than 35 mm, less than 30 mm, less than 25 mm, or less than 20 mm. The filaments have a length defined by any two of the above endpoints. For example, the length of the filaments 30 may be between, and including, 15 mm to 50 mm, 25 mm to 30 mm, 20 mm to 40 mm, or 25 mm to 35 mm.

In one example, the rotating brush 28 is replaceable. For example, the user may replace the rotating brush 28 with a different rotating brush 28 that has, for example, a different density of filaments 30 or a brush that has a different pattern of filaments 30, thereby allowing the user to create various misting conditions and patterns.

The rotating brush 28 may be driven by an electrical motor 44. Alternatively, the rotating brush 28 may be driven by a manual crank, such as a thumb roller. In either case, a user may be able to designate or otherwise control the speed of rotation of the brush 28. In an example, the device 10 is configured to convert 500 mL to 800 mL of liquid into a mist per hour. For example, the device may be configured to convert 600 mL of liquid into mist per hour.

In an example, as shown in FIG. 2, the device 10 includes a housing 34. In one example, the housing 34 is generally cylindrical. However, the size and shape of the housing 34 is not limiting. While FIG. 2 shows a generally cylindrical housing 34, it is understood that the housing may be any number of shapes adapted to support the misting device 10. The housing 34 may include the contact plate 12 and the rotating brush 28. The housing 34 may include an opening 36, wherein, as the brush 28 rotates, liquid from the filaments 30 project through the opening 36. For example, the housing 34 may include a top portion 38 and a bottom portion 40, wherein the contact plate 12 is positioned within the bottom portion 40, wherein the opening 36 is positioned within the top portion 38.

The shape of the opening 36 may be any suitable shape. For example, the shape of the opening 36 may be generally rectangular, square, circular, or oblong. The opening 36 may be a narrow slit, a small circular opening, or a larger rectangular opening. Further, the housing 34 may include more than one opening 36, thus, allowing the device 10 to provide various patterns of misting. For example, the top portion 38 of the housing 34 may include a row or series of small openings 36.

In an example, the size of the opening 36 in the top portion 38 of the housing 34 may be adjustable. For example, the opening 36 can be enlarged or diminished manually or electronically. In the case of manual adjustment, the opening 36 may have adjustable components that allow a user to change the shape of the opening, even during use. In addition, the capillary openings 20 may be capable of being opened and closed in certain groups, allowing for a customized liquid spray swath.

In another example, as shown in FIG. 3, the device 10 includes an arcuate barrier 42 extending from below the contact plate 12 around a portion of the brush 28, wherein the arcuate barrier 42 may collect a portion of a liquid released from the filaments 30. The barrier may be a portion of the housing 34. Alternatively, the barrier 42 may be in addition to the housing 34.

As shown in FIG. 3, the barrier 42 extends from below the contact plate 12 to approximately 90 degrees from the contact plate 12, wherein the approximate 90 degrees is measured along the radial path of the filaments 30. In such example, the barrier 42 may collect any liquid prematurely released at or less than 90 degrees. The barrier 42 may in fluid communication with the liquid source 26, such that the collected liquid may be fed back into the liquid source 26.

In the case of a radial rotation of the brush holding the filaments, a portion of the liquid carried by the filaments 30 is released from the filaments approximately 180 degrees from the contact plate 12 in the form of a mist, wherein the approximately 180 degrees is measured along the radial path of the rotating brush 28. Because atomization does not take place until the filaments 30 oscillate, and the oscillation only starts after the filaments 30 have rotated approximately 90 degrees, the direction of the sprayed droplets is 180 degrees from the contact plate 12. In contrast to conventional sprayers that sling liquid approximately 90 degrees from a snap plate without any oscillation process, the present device projects mist at approximately 180 degrees from the contact plate 12.

The device 10 may be configured to produce atomized particles of any suitable size or shape. For example, to produce larger particles, the rotation rate of the rotating brush 28 may be slowed down, the amount of liquid supplied to the filaments 30 may be increased, the diameter of the capillary holes may be increased, the thickness of the filaments 30 may be increased, the stiffness of the filaments 30 may be decreased, or combination thereof. Alternatively, to decrease the size of the liquid particles extruded from the device 10, the rotation rate of the rotating brush 28 may be increased, the amount of liquid supplied to the filaments 30 may be decreased, the diameter of the capillary holes may be decreased, the thickness of the filaments 30 may be decreased, the stiffness of the filaments 30 may be increased, or a combination thereof. The shape of the particles may be spherical, ovular, torpedo-shaped, cylindrical and bullet-shaped. Further, the device 10 may be configured to spray the liquid particles varying distances, for example, the stiffness of the filaments 30 may be increased to spray the particles longer distances compared to filaments 30 with decreased stiffness. Finally, the device may atomize liquid so rapidly that it produces immediate evaporation of liquid into gas, skipping entirely the intermediary step of creation of small particles.

The liquid particles may have an average size (i.e., average particle diameter) of at least 10 μm, at least 20 μm, at least 30 μm, at least 40 μm, or at least 60 μm. Alternatively, or in addition to, the liquid particles may have a diameter size of 350 μm or less, 300 μm or less, 200 μm or less, 180 μm or less, 160 μm or less, 150 μm or less, 120 μm, 100 μm or less, 50 μm or less, or 20 μm or less. The liquid particles can have an average particle size bounded by any two of the above endpoints. For example, the liquid particles may have an average particle size of 10 μm to 20 μm, 10 μm to 50 μm, 10 μm to 200 μm, 20 μm to 100 μm, 20 μm to 3500 μm 50 μm to 120 μm, 20 μm to 150 μm, or 60 μm to 100 μm. In an example, the device 10 is enabled to dispense liquid from the filaments 30, wherein the liquid may be projected in the form of droplets, wherein at least 50% of the droplets have a diameter size of 100 microns or less.

In an example, the device 10 is configured to produce approximately 7 droplets of average diameter size of 115 microns per complete oscillation cycle of each filament, converting approximately 0.25 mL of liquid into mist per hour per filament 30, when the filament 30 passes through approximately 800 cycles of liquid adhesion and oscillation of mist per minute.

Figure 4A:
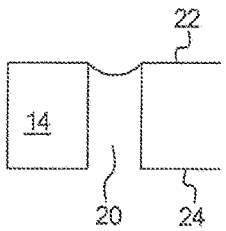
FIGS. 4A-4C is a side view of an embodiment of a filament in contact with a capillary opening.
Figure 4B:
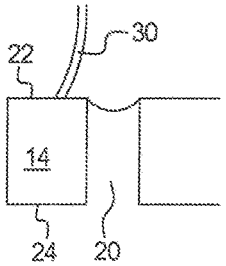
Figure 4C:
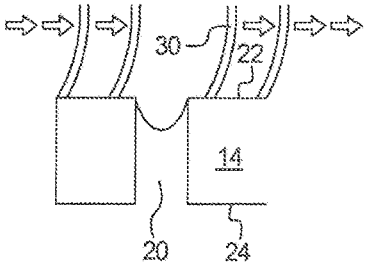
Figure 7A:
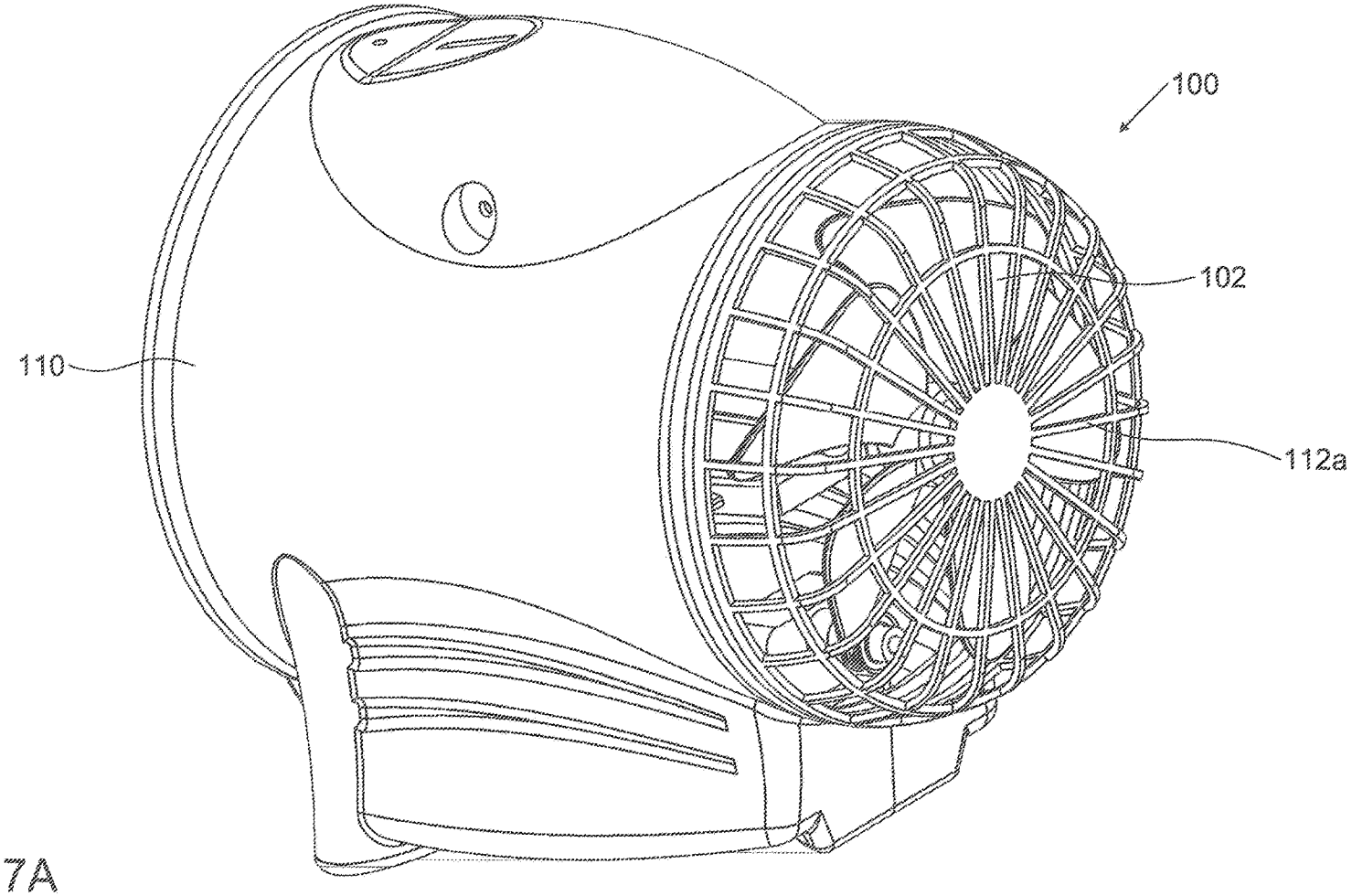
FIG. 7A is a back perspective view of cooling apparatus having an atomization device integrated therein.
Figure 7B:
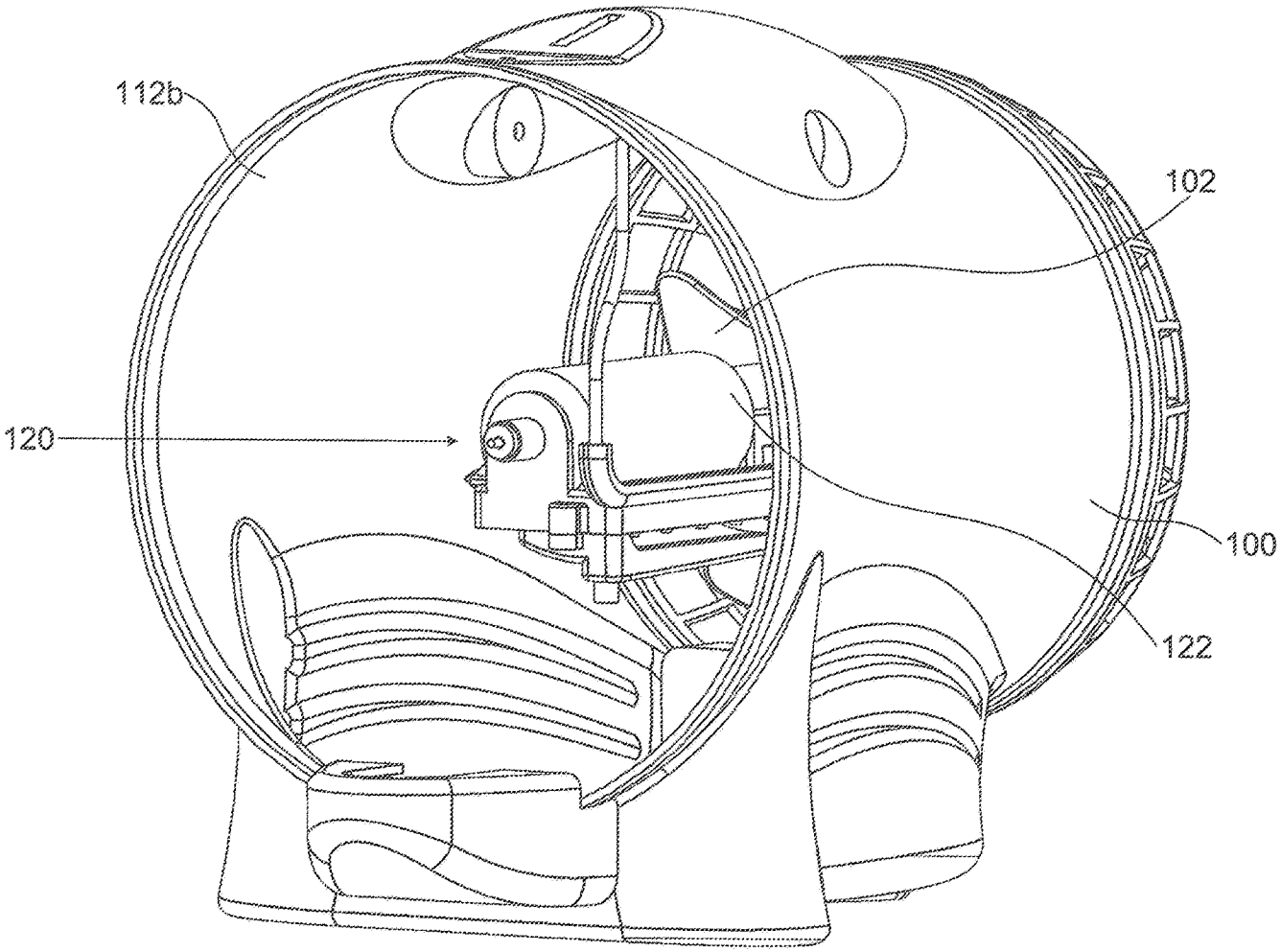
FIG. 7B is a front perspective view of cooling apparatus having an atomization device integrated therein.

The present disclosure also provides an atomization method including providing any of the embodiments of the atomization device 10 disclosed above. The method further includes rotating the brush 28 such that the filaments 30 contact the contact plate 12, wherein the filaments 30 absorb a portion of the liquid available to the filaments 30 from within the capillary openings 20. As shown in FIGS. 4A-4C, a filament 30 brushes over the top plate 14 of the contact plate 14 and absorbs liquid from the capillary opening 20 even though no external source is forcing any additional liquid through the capillary opening 20. As shown in the progression between FIG. 4B to FIG. 4C, once approximately 8000 filaments 30 pass over the capillary opening 20, the height of the meniscus of the liquid inside the capillary opening 20 decreases by approximately 1 mm, wherein the capillary opening has a diameter of 1.1 mm. This conforms to the rough estimate in item 0019 of each filament absorbing approximately between 0.0000001 and 0.000000001 of a cubic centimeter of liquid with each pass over a capillary tube: 8000 times 0.0000001 cubic cc=0.0008 cubic cc, or about 1 cubic millimeter, the volume of liquid lost to the capillary opening.

As the brush 28 rotates a first radial direction, the filaments 30 flex when in contact with the contact plate 12 and release when contact is broken with the contact plate 12 to project liquid from the filaments 30. As shown in FIGS. 5A-5E, after the filaments 30 are released from the contact plate 12, the filaments 30 return to a neutral (linear) position, then continue to bend in the opposite direction of the flexing from the contact plate 12. Then the filaments 30 return back to the neutral position again, and then bend backwards past neutral, releasing one drop with each change in direction. The particular oscillation cycle of the filaments 30 to bend beyond the neutral or linear position of the filament 30, creates the claimed atomization. In other words, bristles of conventional sprayers may be merely bent back and then snapped forward to return to their linear position, applying a flicking motion instead of the oscillating motion utilized by the present device.

A 0.012 nylon filament 30 that is one inch long produces 22 cycles of oscillation, or about 44 recoils. In oscillation tests a filament 0.012" in diameter 1" long can cast a stream of individual droplets separated by identical intervals of time in the range of 22 droplets per ¼ second in one direction. The device 10 utilizes approximately the first 15% of the oscillations when operated at 600 rpm. With each oscillation, the filament projects one droplet of liquid adhering to the end of the filament 30 in the forward direction of rotation, and another in the backward direction. The acceleration at the point of reversal of direction is comparable to the power concentrated at the atomizing point of a spinning disc atomization system rotating at 3,500 rpm.

FIG. 6 depicts an embodiment of the contact plate 12, wherein the bottom plate 16 includes stays 46 that extend vertically from a top surface of the bottom plate 16 to the bottom surface 24 of the top plate 14. In addition, the bottom plate 16 may include multiple liquid sources 26, such that liquid is fed into the individual spaces 18 between the stays 46. As a result, a liquid source 26 is adapted to supply liquid to a portion of capillary stays between stays 46. Such example is particularly suitable for atomizing more viscous liquids such as paint that are not suitable to the capillary plate design used for water, which can already be used in any orientation.

The stays 46 allow the device to be used in various orientations. In other words, the device 10 may be tilted during use while still maintaining adequate misting ability. Without the incorporation of the stays 46, when the device is tilted, all of the liquid in the space 18 may accumulate in one end of the space 18. As a result, only the capillary openings 20 at the end where the liquid is accumulated will absorb the liquid, thereby altering the availability of the liquid to the filaments 30. In contrast, with the incorporation of the stays 46 between the top plate 14 and the bottom plate 16, the device 10 may be tilted without the liquid accumulating at one end of the space 18. Instead, the stays 46 ensure an adequate amount of liquid is accessible by all of the plurality of capillary openings 20 regardless of the orientation of the device 10.

The device 10 may further include an overflow mechanism configured to maintain an adequate amount of liquid in the liquid source 20 in order for the device 10 to produce a consistent mist of liquid. The overflow mechanism may be any mechanical or electrical device configured to maintain a specific amount of liquid in the liquid source 26. The overflow mechanism may be in communication with liquid source 26, such that upon feedback from the liquid source 26 that the amount of liquid exceeds the optimal amount for the device 10 to produce a continuous mist, the overflow mechanism stores or directs excess liquid to a liquid reservoir. The overflow mechanism may be in communication with the space 18, such that upon feedback from the space 18 that the amount of liquid exceeds the optimal amount for the device 10 to produce adequate atomization, the overflow mechanism stores or directs excess liquid to the liquid source 26. In another embodiment, the device 10 may include a float valve configured to maintain a certain amount of liquid in the space 18. Alternatively, the predetermined level or height of the liquid in the space 18 may be made adjustable using an adjustment knob.

The device 10 may further comprise an air force mechanism that provides air flow that further aids in mist production. The air force mechanism may be any mechanism that provides air flow, for example, although not limited to, a fan. For example, the air flow may flow along the length of the rotating brush 28. Alternatively, the air force mechanism may provide air flow that is tangential to the rotation of the rotating brush 28. For example, the air force mechanism may provide air in the direction of the opening 36 in the housing 34, thereby aiding the release of liquid from the filaments 30. The air force mechanism may also provide a cooling effect, for example, when the liquid is water.

It should be noted that various changes and modifications to the embodiments described herein will be apparent to those skilled in the art. Such changes and modifications may be made without departing from the spirit and scope of the present invention and without diminishing its attendant advantages. For example, various embodiments of device 10 may be provided based on various combinations of the features and functions from the subject matter provided herein.

Reference is now made to FIGS. 7A to 8C, according to an example of the presently disclosed subject matter there is provided a cooling apparatus 100 having an atomization system 120 integrated therein. The cooling apparatus according to the illustrated example includes a fan 102 configured to rotate about an axle 104 and to produce airflow in a first direction. According to the illustrated example the cooling apparatus 100 includes a housing 110 having an inlet opening 112*a* and an outlet opening 112*b*. The fan 102 is mounted adjacent the inlet opening 112*a* such that the fan 102, when operating, urges airflow into the housing 110 through the inlet and out of the housing through the outlet opening 112*b*.

The atomization system 120 according to the illustrated example includes a rotating brush 122 having a plurality of filaments. The rotating brush 122 is configured to rotate about the same axis as the axis of rotation of the fan 102, or along a parallel axis. According to an example the rotating brush 122 is configured to rotate together with the fan, i.e. both the fan 102 and the rotating brush 122 are rotated by a motor 115. The motor can be configured to rotate the fan 102 and the rotating brush 122 in the same speed or at different speed for example by a set of cogwheels or other mechanical member configured to transmit rotational motion.

It is appreciated that while the speed of the fan 102 can be set in accordance with the desired airflow output, the speed of the rotating brush 122 can be determined in accordance with the desired fluid atomization rate. That is to say, according to an example, the apparatus 100 can be configured to allow the user to select the speed of the fan 102. In addition, the apparatus can be configured to allow the user to select the speed of rotating brush 122 and thus the fluid atomization rate. Alternatively, the fluid atomization rate can be set in accordance with the selected fan speed.

It is appreciated that the rotating direction of the rotating brush 122 is configured such that the fluid particles are directed in transverse with the airflow direction. That is to say, the fluid particles produced by the atomization system 120 are configured to be sprayed inside the housing 110 in a direction different than the direction of the outlet opening 112*b*. In this connection, it should be noted that small particles of liquid, such as particle less than 50 to 75 microns in diameter, present a low mass relative to their surface area. Thus, when the rotating brush 122 produces particles of such diameter, these particles are carried down along the housing 110 towards the outlet opening 112*b* and rapidly evaporate, cooling the air without wetting any object outside the housing 110.

When however, large particles of fluid occasionally escape the rotating brush 122, these particles do not fly out of the housing 110. This is due to the fact that the larger particles have a greater ratio of weight to surface area such that the forces exerted by the air flow are not sufficient for catching the particles and hurling them towards the outlet opening 112*b* of the housing 110.

In addition, according to the present implementation the particles are hurled at an air speed of approximately 1.5 meters per second in the radial direction, further preventing the air flow from blowing them towards the outlet opening 112*b* of the housing 110. Instead the larger particles travel unimpeded towards the sidewall of the housing, where the particle gravitates to the bottom of the housing 110, as explained hereinafter.

The apparatus 100 further includes an array of capillary channels 130 disposed such that the edge thereof is engaged with the circumference of the rotating brush 122. The capillary channels 130 can be defined on a plate 132 disposed inside a liquid trough 135 which is in fluid communication with a water source (not shown) via a feed tube 138.

Figure 8A:
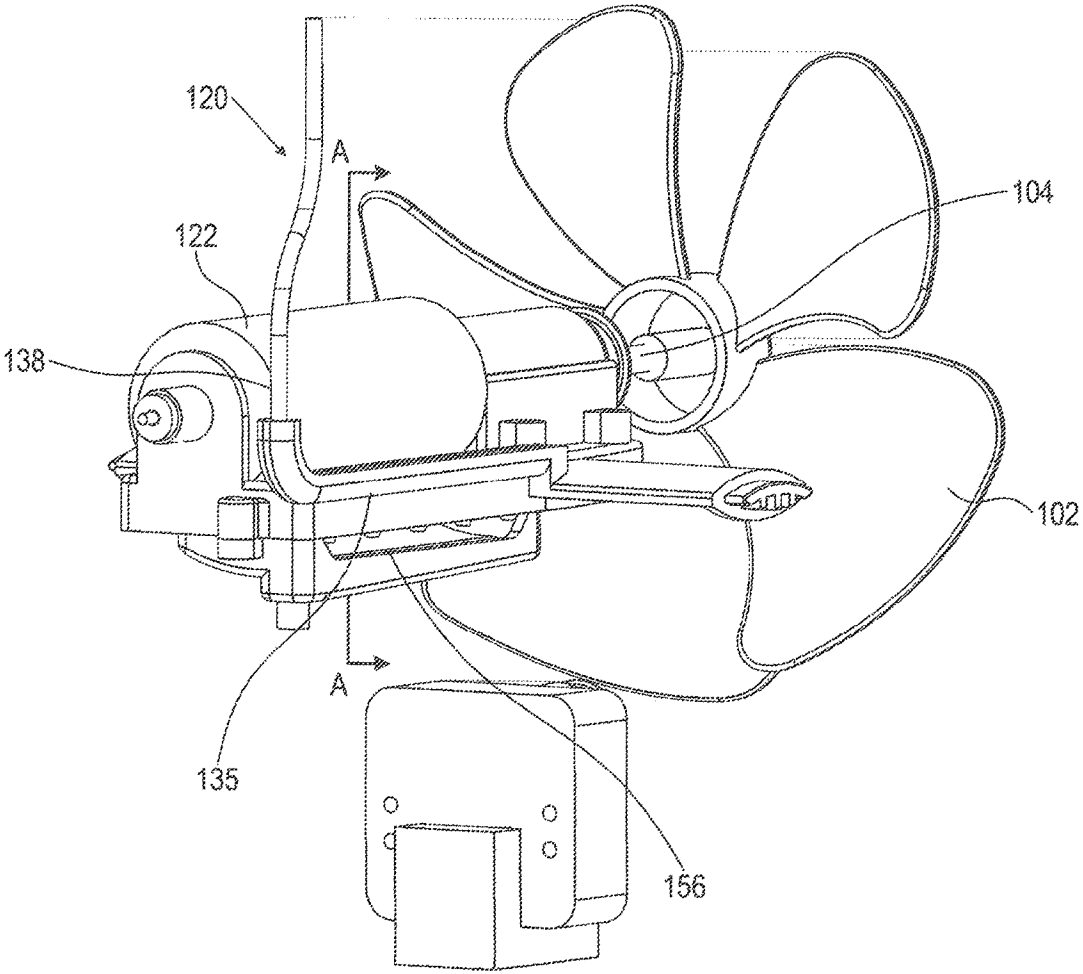
FIG. 8A is a perspective view of the atomization device of the cooling apparatus of FIG. 7A.
Figure 8B:
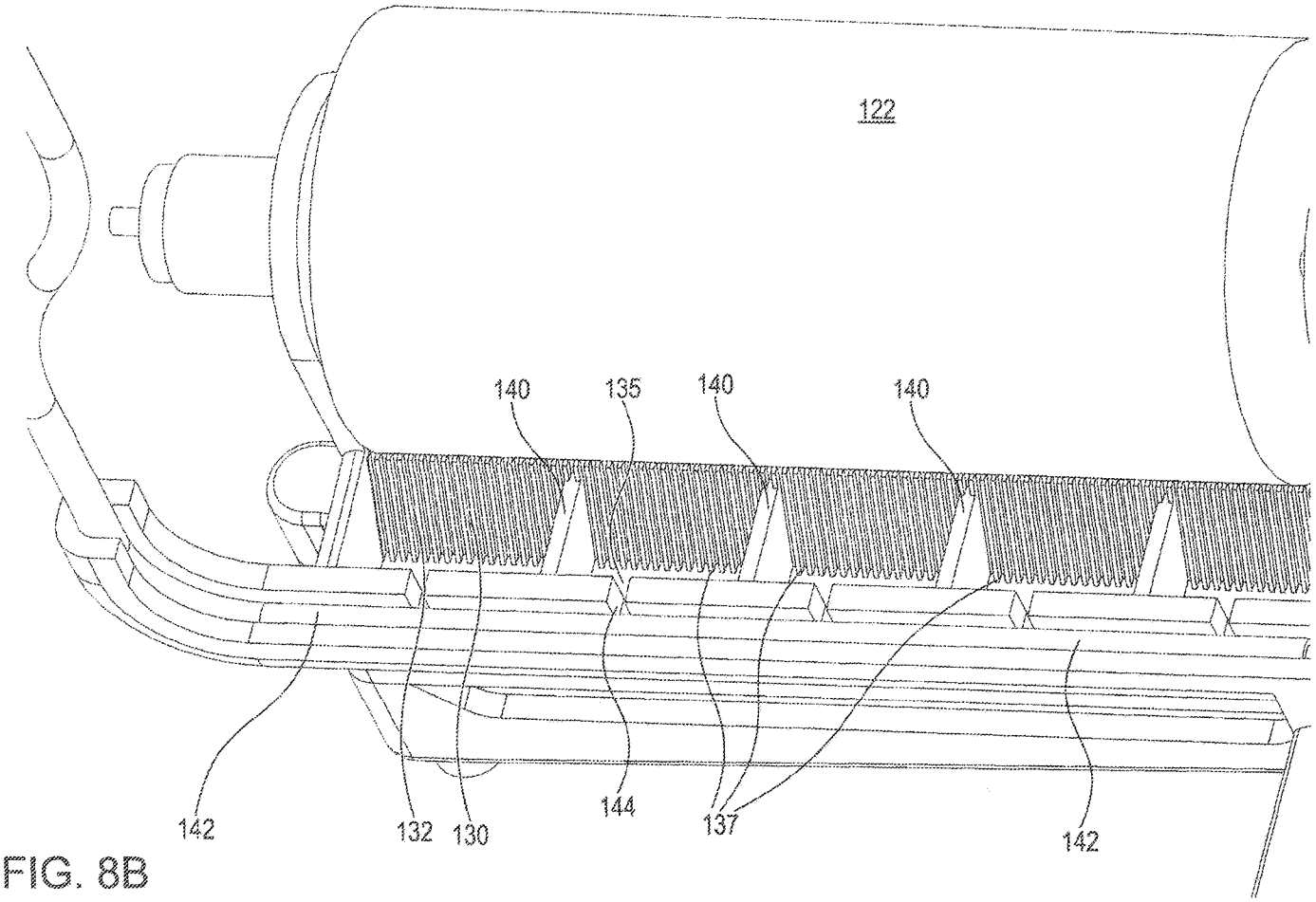
FIG. 8B is an enlarged view of the capillary channels of the atomization device of FIG. 8A.

As most clearly shown in FIG. 8B, the plate 132 is diagonally disposed in with respect to the trough 135, such that on one hand, the capillary action causes liquid from the trough to be urged upwardly, and on the other hand, the slope prevents excess liquid from reaching the circumference of the rotating brush 122.

It is appreciated that the angle of the plate 132 with respect to the trough 135 can be determined in accordance with the required transfer rate under the capillary action and the properties of the liquid.

Figure 8C:
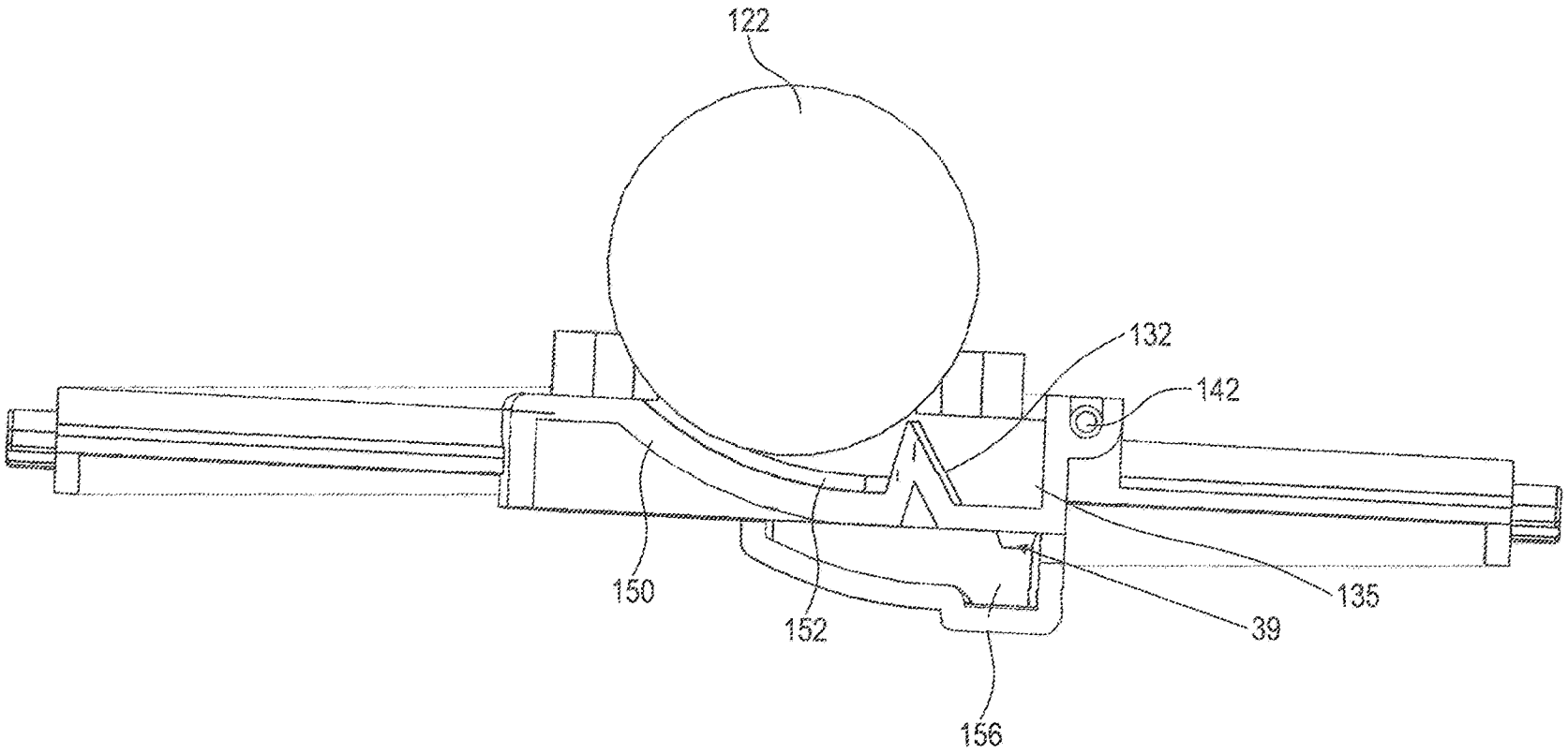
FIG. 8C is a sectional view enlarged view of the atomization device of the cooling apparatus of FIG. 7A taken along lines A-A.

As shown in FIG. 8C, the trough 135 and the plate 132 with the capillary channels 130 can be extended along the entire length of the rotating brush 122 such that filaments along the entire length on the rotating brush 122 can collect liquid by adhesion from the edge of the capillary channels 130.

According to an example, the trough 135 can include a plurality of buffers 140 disposed such that the volume of the trough 135 is divided to a plurality of partitions 137, preventing liquid from passing between adjacent partitions 137. This way, the desired level of liquid within the trough can be maintained across the entire length thereof. That is to say, in case the apparatus 100 is disposed on at an angle, such that liquid in the trough 135 tends to gravitate towards one side thereof, leaving the opposing side with less liquid. In this situation, channels 130 defined in areas of the plate 132 corresponding to higher side of the trough 135 do not have liquid to allow the capillary action, and corresponding portions of the rotating brush 122 will not produce the liquid particles. Thus, the buffers 140 prevent the liquid from passing between partitions 137, such that liquid is maintained in each partition independently of other partitions allowing a continuous capillary action in substantially all the channels 130 defined along the plate 132.

According to this example, the feed tube 138 is configured to provide liquid to each of the partitions 137. The feed tube 138 can be configured to provide liquid to a liquid passage 142 defined along the partitions and having openings 144 allowing liquid to pass into each of the partitions 137 at a desired flow rate. Each of the partitions 137 can be provided with a draining aperture 139 configured such that gravitational forces exerted by the liquid pressure in the partition 137 force liquid out the partition 137 through the drain 139. The greater the flow rate of liquid entering from the feed tube 138, the greater will be the height of the liquid in the partition, because as the partition 137 fills up the speed of the flow rate of the draining aperture increases marginally until a new equilibrium is reached at the new, higher level. Thus by adjusting the flow rate of the incoming liquid from the feed tube 138, the height of the liquid in the partition can be set as desired.

The flow rate of liquid entering and leaving the partition 137 is much greater than the amount of liquid removed by the filaments during the same amount of time, so this design effectively removes the requirement to match the flow rate of incoming liquid to the amounts needed by the filaments. Providing liquid at exactly the amount required by the filaments would be an extremely complex and expensive task. The height of the liquid can be controlled for example by varying the rate of the drip coming in from the feed tube 138, by means of a drip controller provided at the openings 144.

It will be appreciated by those skilled in the art that higher and lower levels in the partition 137 produce faster and slower capillary rise in the plate 132, which in turn provides faster and slower adhesion of liquid to the filaments, respectively. Hence the rate of atomization of liquid from the device can be accurately controlled by varying the drip rate of the entering fluid.

The capillary channels 130 according to the present invention are configured at a narrow liquid path configured such that intermolecular forces are exerted between the liquid and walls of the capillary channels 130. It is thus appreciated that the width of the channels 130 is sufficiently small, such that the combination of surface tension and adhesive forces between the liquid and channel wall act to lift the liquid. The width of the channels can be determined in accordance with the cohesion property of the liquid.

According to the present example, the channels 130 are configured such that each channel includes two side walls and a bottom portion, while top portion thereof is opened. This way, the liquid inside the channel 130 interacts only with three side walls of the channels 130, reducing thereby the capillary rise rate. As described below, the process of adhering extremely small amounts of liquid to the filaments is most effective when the capillary forces urging liquid up the tubes are prevented from maintaining the level of the meniscus as high as it can be. The lower capillary rise rate of the three sided channel 130 facilitates the atomization process carried out by the filaments, as explained herein below.

It is appreciated that in the atomization system 120 of the present example the filament acquires liquid by adhesion at very nearly the same moment that it is bent to be snapped, i.e. during the disengagement of the edge of the filament and the plate 132.

This is as opposed to the previous example in which the filament first collects liquid from the capillary tubes and then engages a top plate and only then is snapped when disengaging from the top plate (plate 14 of FIG. 2). Accordingly, in the present example, the simultaneous engagement of the filament with the capillary channel and collection of liquid therefrom immediately followed by the disengagement of the filament from the capillary channel such that the filament is free to oscillate. Thus with the atomization system 120 of the present example introduction of unacceptably large droplets is reduced, and the filament efficiently increases the creation of extremely small droplets constituting excellent atomization.

Attention is now directed to FIGS. 9A to 9D, according to an example, the rotating brush 122 includes a plurality of filaments 134 defined along the entire length thereof and the entire circumference. The rotating brush 122 is so disposed with respect to the plate 132 such that the edge of each of the filaments 134 engages the edge of one of the capillary channels 130 one time in a rotation cycle. This way, each filament 134 collects a small amount of liquid by adhesion from the edge of the capillary channel 130 one time in a cycle.

That is to say, as opposed to the previous examples in which the filaments are configured to engage a surface having a sequence of opening of capillary tubes, according to the present example, the filaments 134 are configured to engage only an edge of a single capillary channel 130. Adhesion at the edge of the capillary channel 130 results in deforming the meniscus and further limiting the amount of liquid that adheres to the filaments 134. This way, the amount of liquid absorbed by each filament 134 is consistent and is dictated by varying the rate of the capillary action, for example by controlling the height of the liquid in the channels.

As indicated above, according to the present example, the capillary channel 130 include only three side walls such reducing thereby the rate of the capillary action. This way, during the rotation of the rotating brush 122, filaments 134 about the circumference of one segment of the rotating brush 122 successively engage a corresponding capillary channel 130. The relatively slow capillary action does not allow liquid to reach the top of the plate 132 in the time interval between engagement of a first filament and engagement of a successive filament. Thus, the amount of liquid absorbed by the filament is controlled is maintained low allowing thereby a much finer atomization of the liquid. Accordingly, it is appreciated the amount of liquid absorbed by each filament can be controlled by adjusting the height of the liquid in the channels 130, which increases the capillary rise rate, or by adjusting the time interval between engagement of a filament with the edge of the capillary channel 130 and engagement of a successive filament with same capillary channel 130, determining thereby the amount of liquid which can reach the edge of the capillary channel 130 during this time interval. The time interval can be adjusted by adjusting the rotation speed of the rotating brush 122, or by distancing the filaments from one another, etc.

Figure 9A:
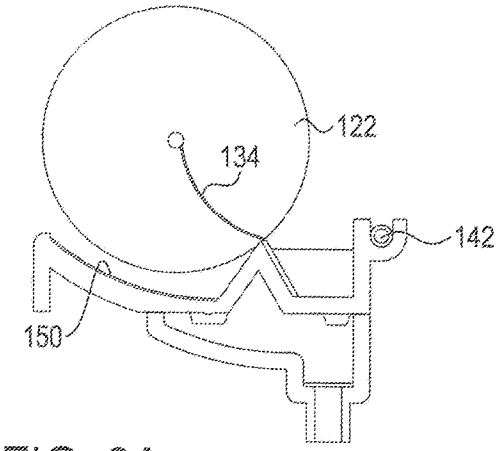
FIGS. 9A-9D are side sectional views of the atomization device exemplifying various dispositions of a single filament on the rotating brush.
Figure 9B:
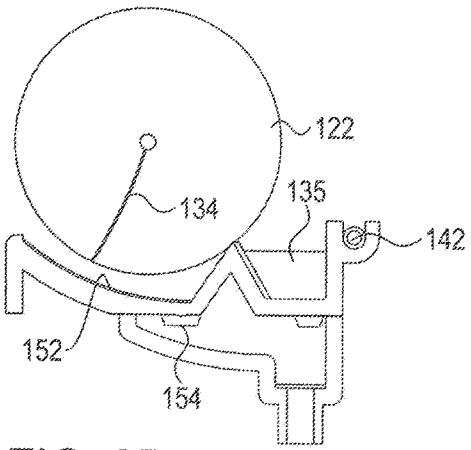
Figure 9C:
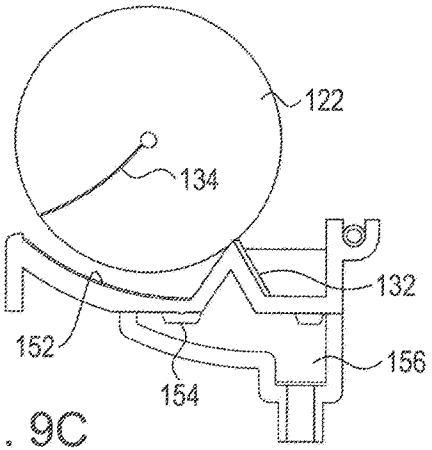
Figure 9D:
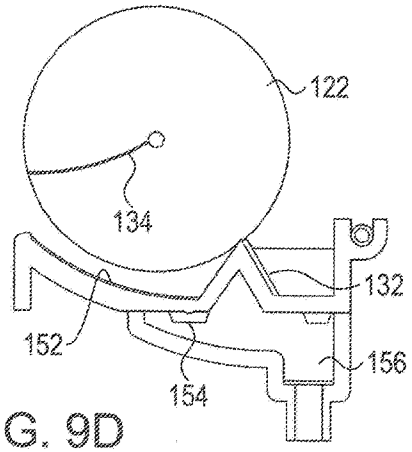

As shown in FIG. 9A, as the rotating brush 122 is rotated a filament 134 engages the edge of the plate 132, the engagement and the continuous rotation of the rotating brush 122 in one direction urges the filament 134 to bend in an opposite direction. As the rotating brush 122 further rotated in same direction, the edge of the filament 134 is forced to disengage the edge of the plate 132, such that the filament is bent to the opposite direction, as shown in FIG. 9B. As in the previous examples, any liquid hurled off by the initial sling of the filament from the barrier is not desired, because such occasional droplets as do arise at that point are much too large for effective atomization. Effective atomization demands not only the creation of a large number of very small droplets, but it also demands the total exclusion of large droplets from the atomized product. Any liquid cast off by a barrier, such as a collecting member 150, as described hereinafter, is caught and returned to the reservoir.

As in the previous examples, the filaments 134 are made of a material allowing an oscillating motion thereof alternately bending between a first and second direction, i.e between the rotating direction of the rotating brush 122 and an opposing direction. This oscillation allows producing droplets of sufficiently small size. The oscillating motion urges the liquid particles to escape the rotating brush 122, bringing about the atomization of liquid absorbed by the filament 134. According to an example the filaments 134 are configured such that the bending direction thereof after disengaging the edge of the plate 132 is the rotating direction of the rotating brush 122. The filament oscillates while it is rotating, speeding up and slowing down during its rotation, and creating relatively high forces of acceleration at each change in direction. These forces naturally apply even though the filament continues in the overall rotation. When the filament is disengaged from the plate 132 it is traveling much faster than the rate of rotation, catching up with where it would have been had it not encountered the plate 132. As the filament 134 continues along the rotational path of the rotating brush 122, the oscillation of the filament stops, in this example after a quarter turn, and quickly changes direction and oscillates in the opposite direction. The acceleration caused by this rapid change in direction causes the filament to cast off a very small droplet. According to an example, the filament 134 is configured to bend back to the opposite direction only after the rotating brush 122 is rotated approximately 90 degrees with respect to the plate, causing it to hurl off one droplet in a direction 180° with respect to the plate, increasing thereby the effectiveness of the atomization. This way, the direction in which the liquid particles are released is controlled.

For example, it has been found that a filament having a length of 21 mm and a diameter of 0.3 mm is suitable to atomization of liquids of the lowest viscosity, such as water. In the case of using water evaporation for air cooling, according to an example there is not requirement that any particular oscillation be effective, rather it is desired to have as many as possible, 3 or 4 oscillations of the filament casting off liquid. However in the case of applying the device to painting surfaces, the oscillations must be more strictly controlled if the effect of hurling droplets in a specific direction is to be achieved. Thus in the case of paint, only the first half oscillation may be utilized for the atomization, with the liquid being hurled from the filament exactly in the direction desired. In this manner a droplet with a much higher air speed than other paint atomization methods can be achieved, actually hurling the droplets deep into cracks unreachable by other methods. In this vein a filament having a length of 14 mm and a diameter of 0.035 is useful for more viscous liquids like latex paint, where more force is required to cast off the droplet. A shorter, thicker filament like this has much fewer oscillations than the thicker, longer one used for water—3 to 4 oscillations instead of more than 22 oscillations. Since the application utilizes only the product of the first oscillation, the loss of oscillations has no negative effect on the quality of the product. And the thicker filament produces a stronger throw, adding to the air speed of the droplet. A filament having a length of 11 mm and a diameter of 0.035 is useful for even more viscous liquids like such as think paint, where more force is required to cast off the droplet.

A filament having a length of between 14 and 21 mm and a thickness between 0.3 and 0.035 mm would be suitable for liquids of more viscosity than water but less than that of paint, for example, olive oil.

The apparatus 100 according to the illustrated example further includes a collecting member 150 extending from the plate 132 along a portion of the rotational path of the rotating brush 122. The collecting member is configured to collect excess liquid absorbed by the filaments 134. For example, sometimes the filaments sling off droplets that are too large following the disengagement of the filament and the edge of the plate 132. These inefficiencies may be due to imperfections in the distribution of the filament heads along the length of the brush, or to other imperfections. The unwanted, too-large droplets are thus collected by the collecting member 150, which can be include a sloped surface 152. The sloped surface with configured to directed the excess liquid to an outlet aperture 154, which is in fluid communication with a fluid tank 156. The fluid tank 156 can be in fluid communication with the feed tube 138, such that the excess liquid is reused to feed liquid into the trough 135. The collecting member 150 can be further configured to block liquid particles escaping the rotating brush 122 at an undesired location. That is to say, if it is desired to let liquid particles escape the rotating brush 122 to the inside of the housing 110 such that the particles merge into the airflow generated by the fan 102. Accordingly the liquid particles escaping in other directions can be blocked by the collecting member 150, and collected back to the fluid tank 156.

Since, as indicated above the liquid particles are directed in a direction transversely to the direction airflow generated by the fan 102, the liquid particles are not directed to the outlet opening 112*b* of the housing 110. This way, liquid particles which are substantially larger are not drifted by the airflow, and strike the side of the housing where they gravitate to the bottom of the housing 110. According to an example, the bottom of the housing can include a sloped portion configured to direct the liquid to a designated area, in which the liquid can be for example, pump back to the fluid tank.

It is appreciated that for the purpose of the cooling apparatus the liquid can be water, or other coolant liquid. It is appreciated that the rotating brush 122 and the capillary channels 130 described in connection with the cooling apparatus, can be implemented in other system such as paint spraying systems etc.

It is further appreciated that in accordance with another example of the present invention, the atomization device can include a brush configured for linear displacement with respect to the edge of the plate. That is to say, the brush can be configured with a cyclic displacement such that when it is displaced in a first direction the filament engages the edge of the capillary channel. The brush is then displaced back in a second opposing direction, such that it can be displaced back in the first direction. The capillary channels can be configured such that the filaments engage the edge thereof only when the brush is displaced in the first direction. This can be carried out for example, by disposing the plate in a diagonal with respect to brush such that the edge thereof is directed towards the first direction.

In addition, although in the previous examples, the brush is displaced with respect to the plate, it will be appreciated by those skilled in the art that the brush can be a static brush, while the plate with the capillary channels is configured to be displaced with respect to the brush such that the filaments engage the edge of the capillary channels. This can be implemented either with a linear displacement of a rotational displacements, or any other displacement.

Those skilled in the art to which the presently disclosed subject matter pertains will readily appreciate that numerous changes, variations, and modifications can be made without departing from the scope of the invention, mutatis mutandis.

The invention claimed is:

1. An atomization device for forming liquid particles the device comprising:

a brush having a plurality of filaments, each of said filaments is coupled on one end thereof to said brush such that an opposing end of said filaments is free to oscillate;

a plate having at least one liquid path configured for capillary action of liquid therein;

wherein one of said brush and said plate is configured to be displaced with respect to the other one of said brush and said plate in a first direction during a cyclic displacement; and wherein disposition of said plate with respect to said brush is such that during said displacement in said first direction at least one of said filaments is displaced between a first position in which said opposing end is engaged with an edge of said liquid path collecting thereby a film of liquid therefrom, and a second position in which said opposing end is free to oscillate in an alternating motion between said first direction and a second opposing direction, and wherein said alternating motion is triggered by forces exerted on said opposing end during disengagement thereof from said edge of said liquid path.

2. The atomization device of claim 1 wherein said cyclic displacement is a rotation displacement.

3. The atomization device of claim 2 wherein said brush is a rotating brush configured to rotate in said first direction with respect to said plate.

4. The atomization device of claim 1 wherein during said alternating motion of said filament said opposing end changes direction from said first direction to said second direction a particle of liquid is dislodged from said opposing end.

5. The atomization device according to claim 1 wherein said brush includes a plurality of filaments coupled along a width thereof and said plate includes a plurality of liquid paths, said plate extends along said width such that in said first position each of said filaments is engaged with said edge of at least one of said liquid paths allowing thereby said plurality of filaments to simultaneously collect liquid from said liquid paths.

6. The atomization device according to claim 1 wherein dimensions of said liquid path is configured such that surface tension and adhesive forces between liquid and walls of said liquid path causes said capillary action and in wherein said dimensions are configured in accordance with a cohesion property of said liquid.

7. The atomization device according to claim 1 wherein said at least one liquid path is a channel having an opening along a portion thereof reducing thereby the capillary rise rate.

8. The atomization device according to claim 7 wherein said channel includes a bottom wall and two side walls wherein said opening is defined along a top portion thereof such that liquid therein interacts only with said bottom wall and said two side walls.

9. The atomization device according to claim 1 wherein said plate is disposed inside a liquid trough, and is configured such that a liquid level therein allows said capillary action.

10. The atomization device according to claim 9 wherein said plate is diagonally disposed with respect to said trough wherein angle of said plate with respect to said trough is determined in accordance with the desired rate of said capillary action.

11. The atomization device according to claim 9 wherein said trough includes a plurality of partitions successively defined along the length of said plate and configured such that said liquid level is maintained in each of said partitions.

12. The atomization device according to claim 11 further comprising a liquid passage defined along said partitions and having openings configured for providing liquid into each of said partitions at a desired flow rate.

13. The atomization device according to claim 11 wherein each of said partitions includes a draining aperture configured such that gravitational forces exerted by the liquid pressure in said partition force liquid out said partition through said draining aperture maintaining thereby said liquid level in said partitions.

14. The atomization device according to claim 1 wherein said brush includes a plurality of filaments configured to successively engage said edge and wherein engagement of each filament with said edge causes deformation of the meniscus in a top surface of the liquid in said liquid path decreasing the height of the meniscus as measured in the middle of said liquid path, and wherein rate of said capillary action is configured such that the time interval between engagement of a filament and engagement of a successive filament, is controlled to be shorter than time required for said capillary action to return said meniscus to its full height.

15. The atomization device according to claim 3 wherein each of said filaments is configured to bend back to said second opposite direction only after said rotating brush is rotated approximately 90 degrees with respect to said plate.

16. The atomization device according to claim 1 further comprising a collecting member extending along a portion of a path defined by said first direction and configured to collect excess liquid absorbed by said filaments.

17. The atomization device according to claim 1 further comprising an air blowing device configured to blow an airstream in a first direction; wherein said brush is configured to spray particles of said liquid in a second direction transversely of said first direction.

18. The atomization device according to claim 1 wherein said air blowing device is a fan rotating about an axis and wherein said apparatus includes a housing having an inlet opening and an outlet opening and wherein said airstream is directed from said inlet opening towards said outlet opening, and wherein said rotating brush is configured to rotate.

* * * * *